US007726238B2

(12) United States Patent
Roberts, Jr. et al.

(10) Patent No.: US 7,726,238 B2
(45) Date of Patent: Jun. 1, 2010

(54) SILK SCREEN SAMPLE PRESS WITH QUARTZ FLASH CURE UNIT

(75) Inventors: Robert Glyn Roberts, Jr., Torrance, CA (US); Jack John Meola, Huntington Beach, CA (US); Rodolfo Antonio Mancia, Covina, CA (US)

(73) Assignee: Fortune Fashion Industries, LLC, Vernon, CA (US)

( * ) Notice: Subject to any disclaimer, the term of this patent is extended or adjusted under 35 U.S.C. 154(b) by 433 days.

(21) Appl. No.: 11/871,142

(22) Filed: Oct. 11, 2007

(65) Prior Publication Data

US 2009/0095175 A1 Apr. 16, 2009

(51) Int. Cl.
*B05C 17/04* (2006.01)
*B41F 35/00* (2006.01)

(52) U.S. Cl. ..... 101/123; 101/126; 101/424.1; 101/488

(58) Field of Classification Search ..... 101/114, 101/115, 123, 126, 129, 416.1, 424.1, 487, 101/488

See application file for complete search history.

(56) References Cited

U.S. PATENT DOCUMENTS 3,854,398 A 12/1974 Martin
4,287,826 A 9/1981 Brabec
4,526,101 A 7/1985 Ericsson
4,671,174 A 6/1987 Tartaglia et al.
4,813,351 A 3/1989 Pierson, Jr.
5,136,938 A 8/1992 Pellegrina
5,218,908 A 6/1993 Whitfield
5,249,255 A 9/1993 Fuqua et al.
5,471,924 A * 12/1995 Helling ..... 101/38.1
5,622,108 A 4/1997 Benedetto et al.
5,908,000 A 6/1999 Spychalla et al.
5,937,749 A 8/1999 Ford
6,152,030 A 11/2000 Fuqua
6,155,170 A * 12/2000 Benedetto et al. ..... 101/424.1

* cited by examiner

*Primary Examiner*—Ren Yan
(74) *Attorney, Agent, or Firm*—Marc E. Hankin; Kevin Schraven; Hankin Patent Law, APC

(57) ABSTRACT

One embodiment of this invention discloses a silk screening device which includes an integrated quartz flash unit. The invention improves upon prior art systems and relates to a system whereby both a silk screen squeegee unit and a quartz flash unit are slidably mounted on a common set of rails, in order to allow each to be easily placed and removed from the silk screening platform.

12 Claims, 6 Drawing Sheets

SILK SCREEN SAMPLE PRESS WITH QUARTZ FLASH CURE UNIT

FIELD OF INVENTION

This invention relates, generally, to silk screening devices; more particularly, to multi-color silk screening devices that utilize an integrated, sliding quartz flash cure unit.

BACKGROUND

The art of silk screening or screen printing has been used by printers for many decades to print multi-colored images on textiles. In order to accelerate and control the curing process of the dye or ink, quartz flash cure units have been developed that emit high-intensity electromagnetic radiation over the dye.

Quartz flash cure units are used by printers, and commonly seen on automatic printing processes, in order to accelerate the printing process on a silk screen printing device. Quartz flash cure units operate, generally, by placing the flash cure unit over a textile, after a pass of the silk screen squeegee, and commencing irradiation. The emission of high-intensity radiation by the quartz flash cure unit assists curing by accelerating and controlling the cure process of the dye. Then, the quartz flash cure unit is moved from the textile and the printer is able to more quickly commence printing another color to the textile, or remove the textile from the device, due to the accelerated curing process.

In order to more conveniently place and remove the quartz flash cure unit, numerous mechanisms have been developed for mounting the flash cure unit. In one common, simple mechanism, quartz flash cure units are mounted on modular rolling stands, which allow the quartz flash cure unit to be rolled over the textile for curing. After the curing process, the unit is rolled away, in order to allow the printer to print another color or remove the textile from the device. In another common automatic printing process, the quartz flash unit is mounted such that it is stationary, and the textile is moved beneath the quartz flash unit for irradiation. In either case, these flash cure unit mechanisms are inefficient and time consuming to place and remove from the curing position. Accordingly, automatic printing processes are very cumbersome and not well-suited for use on sample systems. Thus, certain mechanisms have been developed in order to assist in the process of placing and removing the quartz flash cure unit from over the textile.

One such mechanism is disclosed by U.S. Pat. No. 3,854,398 to Martin, which discloses a screen printing and drying machine wherein print and drying mechanisms are mounted on multiple turrets of the machine. Martin's mechanism accelerates the positioning process by rotating the print and drying mechanism along a common axis. The Martin mechanism, however, is relatively large and complicated and, thus, unsuited to production of individual or small numbers of textiles. Another, similar device is disclosed by U.S. Pat. No. 5,136,938 to Pellegrina, which also discloses a multi-color printing system arranged around a turret. Pellegrina's device improves upon Martin's mechanism by disclosing a similar mechanism that includes a forced air heating and cooling mechanism for curing. Like Martin's mechanism, however, Pellegrina's device is unsuited to the production of individual or a small number of articles.

Other such mechanisms are disclosed by U.S. Pat. No. 4,287,826 to Brabec, U.S. Pat. No. 4,526,101 to Ericsson, and U.S. Pat. No. 4,813,315 to Pierson, Jr., which disclose an in-line, multi-station printing systems that include print and drying stations. Brabec's device is not compatible with common sample printing machines where a single silk screen press is used for passes of multiple colored dyes. Ericsson's device, which places a drying station along a conveyor, is also unsuitable for sample printing machines. Finally, while Pierson, Jr. discloses a shiftably mounted heating device, it fails to disclose a mechanism that is compatible with textile silk screening devices.

Another such mechanism is disclosed by U.S. Pat. No. 4,671,174 to Tartaglia et al. Tartaglia's devices feature a moveable longitudinal heater mounted above the screen printing platens and movable across the platens in order to apply heat to the textiles after printing. In Tartaglia's mechanism, the heating apparatus comprises a carriage separate from the silk screen mounting. Also, the mechanism is adapted to a multi-screen printing apparatus and is, thus, unsuited to screen printing devices used in sample printing.

Another such mechanism, which is adapted for use with multi-station silk screen printing devices, is disclosed by U.S. Pat. No. 5,937,749 to Ford. Ford's device discloses an apparatus wherein a fabric drying heater is capable of being mounted on one or more of the modular silk screening stations on the apparatus. While disclosing a means of using a drying mechanism in conjunction with a screen printing mechanism, however, Ford's device fails to disclose a means that is compatible with sample press machines wherein the squeegee is passed over the article.

Another such mechanism is disclosed by U.S. Pat. No. 6,152,030 to Fuqua, which discloses an apparatus for mounting a curing device to a silk screen device that includes a carriage, which holds the curing device, slidably mounted between a pair of rails and a mechanism for moving the carriage over the printing platen. Thus, like Tartaglia's device above, Fuqua's device also discloses a means for mounting a curing device to a movable carriage.

In neither device, however, is the curing carriage integrated such that it operates using the same rails as the printing mechanism. Thus, none of the disclosed mechanisms teach a system integrating a quartz flash cure unit with a silk screening device in a compact system, wherein the curing device is mounted on rails that also mount the printing mechanism, such that the curing device may be quickly and easily positioned and removed, and wherein the system utilizes a timer for added consistency, and time savings.

SUMMARY OF THE INVENTION

One embodiment of this invention is directed towards overcoming the above shortcomings by teaching a manually operated silk screen press that integrates a quartz flash unit with a silk screen squeegee in a compact system, wherein the quartz flash unit is mounted on rails that also mount the printing mechanism, and the quartz flash unit may be quickly and easily positioned and removed.

One embodiment of the invention operates by mounting a quartz flash unit on the same rails that mount a silk screen squeegee. In this manner, once the operator completes the silk screening procedures on a garment, the squeegee can be moved to a distal position, allowing the quartz flash unit to be moved over the garment. At this point the operator may commence flash operations in order to cure the dye from the silk screening process. In one embodiment of the invention, by utilizing the same rails to mount both the silk screen squeegee and the quartz flash unit, the system operates more easily and allows cost savings during manufacturing.

In one embodiment of the invention, the invention comprises a frame, which mounts parts of the invention. The frame mounts a platform, on which garments and other articles for silk screening are placed. On two sides of the platform are two rails, which serve to slidably mount a silk screen squeegee and a quartz flash unit. The rails are configured such that, during silk screening operations, the quartz flash unit is moved to the distal end of the rails and out of the way of the silk screen squeegee. Meanwhile, during quartz flash operations, the silk screen squeegee can also be moved to the distal end of the rail, allowing the quartz flash unit to be placed over the platform.

In one embodiment of the invention, the frame further includes a pin registration, such that silk screen stencils may be placed over the platform, securely mounted, and properly aligned with the article to be silk screened. The pin registration may feature two or more pins near each corner of the platform, which fit matingly with depressions in the stencil frames. In this manner, this embodiment of the invention ensures that the different passes of the squeegee, in order to ink different colors or stencils, are all properly aligned.

In another embodiment of the invention, the silk screen squeegee is mounted on a cross bar, which attaches to a set of columns that are slidably attached to the rails and extend upwards from the rails to the cross bar. In this manner, the movement of the columns and cross bar along the rails allows the silk screen squeegee to pass over the platform. In yet another embodiment of the invention, the silk screen squeegee is controlled by a hydraulic or pneumatic mechanism in order to regulate the pressure with which the squeegee is pressed against the stencils.

In yet another embodiment of the invention, the quartz flash unit is similarly mounted on a cross bar that attaches to a set of columns, which are slidably mounted to the parallel rails. Many types of quartz flash units, known within the art, are compatible with the invention, including but not limited to: quartz flash units featuring tungsten filament lamps, 120 volt or 208 volt power, foot pedal controlled flash units, digital temperature controlled units, solid state units, and further such variations known within the art. In one embodiment of the invention, the columns mounting the quartz flash unit are telescoping, such that the height of the quartz flash unit relative to the platform is adjustable.

In yet another embodiment of the invention, the system includes a coupling interface configured to selectively couple the silk screen squeegee with the quartz flash unit. Various interfaces can be used to provide the coupling interface, such as a bar with set screws. Preferably, the coupling interface can be operated quickly and efficiently. Coupling the silk screen squeegee with the quartz flash unit enables the silk screen squeegee and quartz flash unit to move together, by actuating either the silk screen squeegee or the quartz flash unit.

In yet a further embodiment of the invention, the system includes a timer which enables coordination and scheduling of various aspects of system operation. The timer can increase consistency of operations, which provides time savings and improvements in the quality of work output.

In summary, the invention teaches an all-inclusive silk screening device which includes an integrated quartz flash unit. The invention improves upon prior art systems by disclosing a system whereby both the silk screen squeegee and quartz flash unit are mounted in order to allow each to be easily placed over the silk screening platform.

DETAILED DESCRIPTION OF THE DRAWINGS

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

In the following description, certain terminology is used to describe certain features of one or more embodiments of the invention. For instance, "quartz flash unit" refers to any electrically powered unit for dispensing electromagnetic radiation in order to assist in the drying of silk screen ink and may feature a foot switch, digital temperature controls, tungsten filament lamps, solid state controls, and further such devices; "silk screen device" refers to any of the single or multi-colored traveling-inker stenciling device known in the art; and "article" refers to any garment, paper, fabric, or other such device commonly printed upon using silk screening devices.

Figure 1:
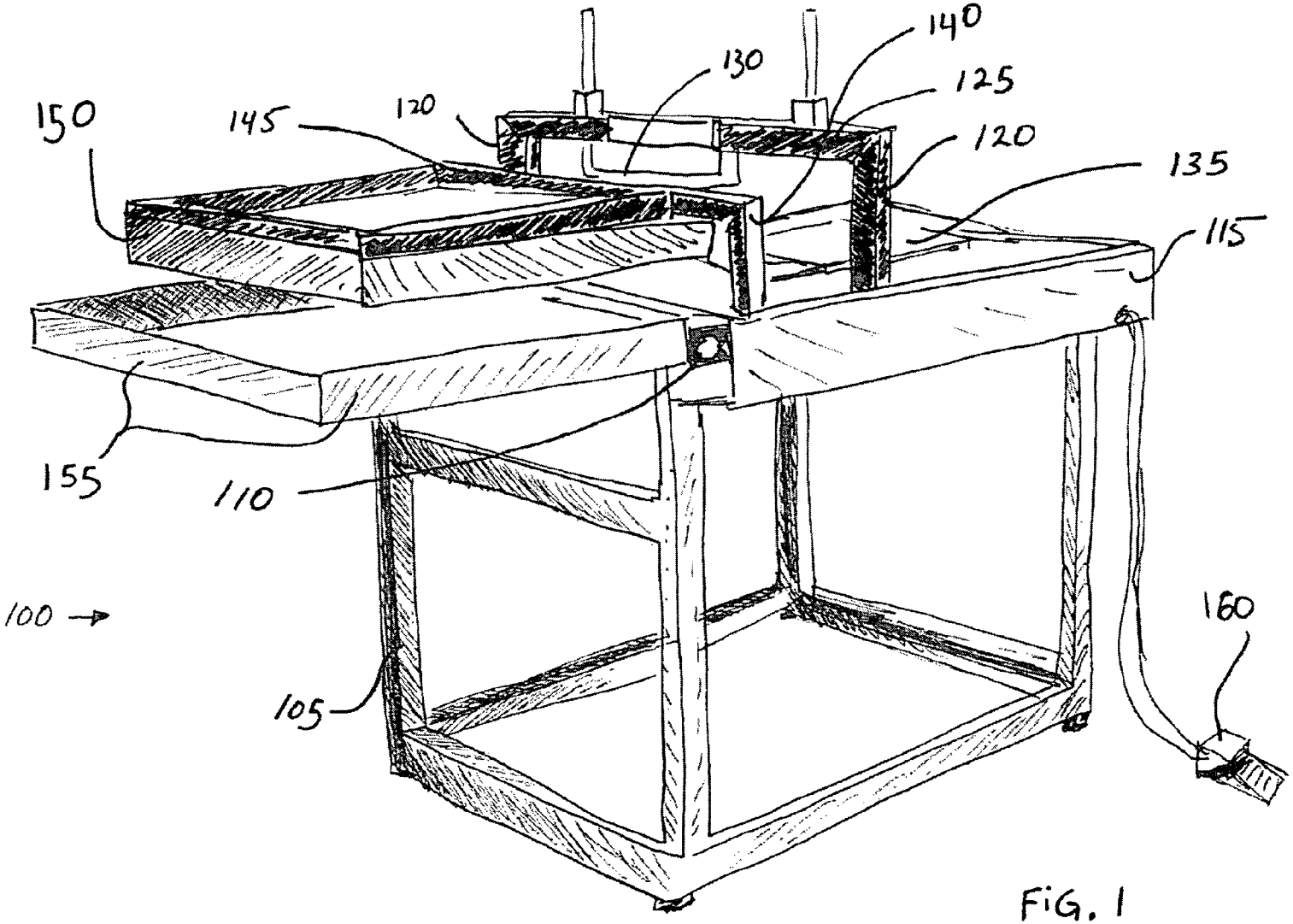
FIG. 1 is an illustration in perspective view of one embodiment of the invention while in a silk screening position.

FIG. 1 is an illustration in perspective view of one embodiment of the invention while in a silk screening position. A silk screening device 100 is shown along with its constituent parts, including: a frame 105, rails 110, rail guard 115, first set of columns 120 for supporting silk screen squeegee parts, first cross bar 125, silk screen squeegee holder 130, platen 135 for supporting articles to be silk screened, second set of columns 140 for supporting quartz flash unit 150, second cross bar 145, and quartz flash unit guard 155. Also, a foot switch 160 is shown, which may be used to activate the quartz flash unit 150 by an operator.

Figure 2:
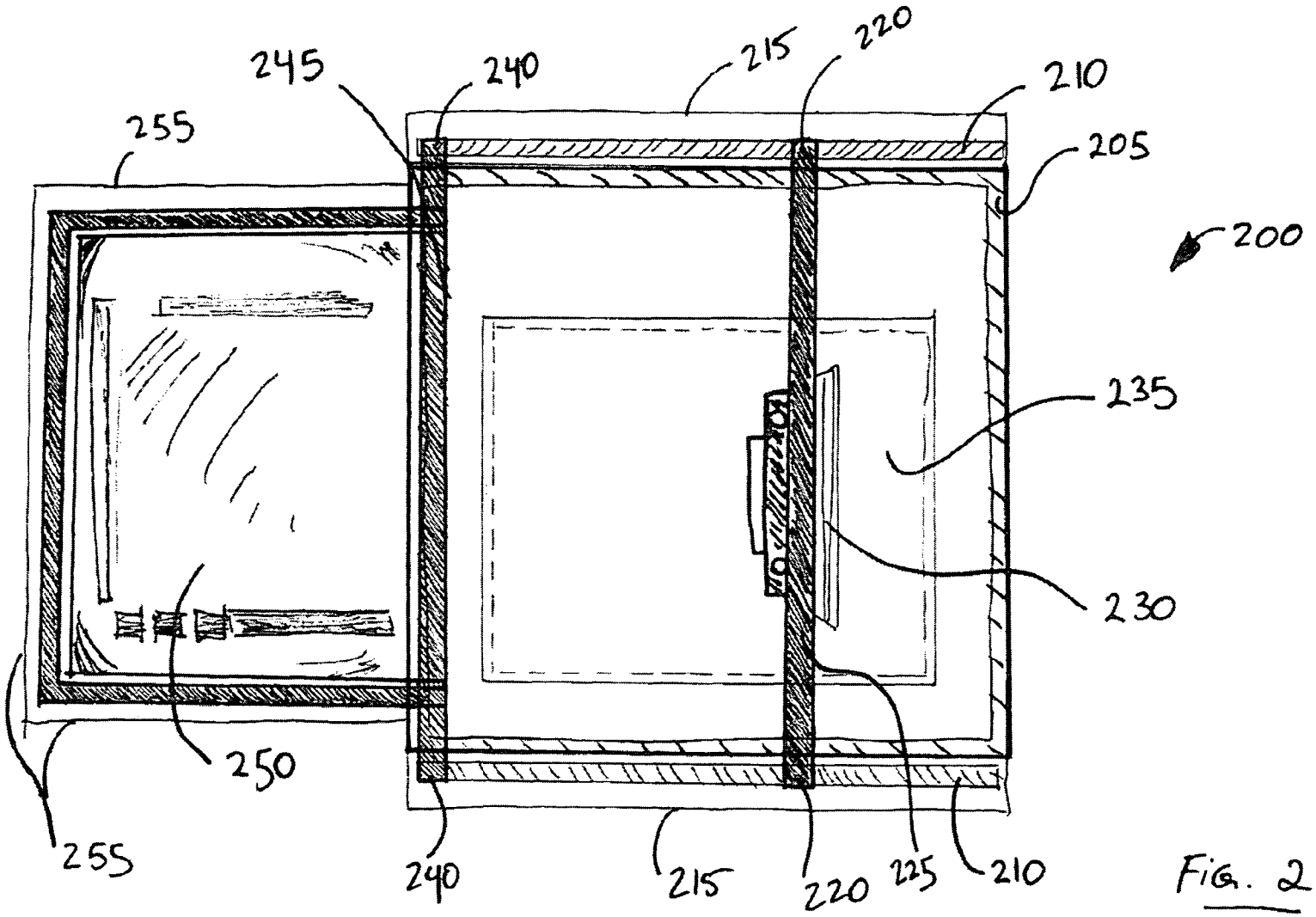
FIG. 2 is an illustration from a top view of one embodiment of the invention while in a silk screening position.

FIG. 2 is an illustration from a top view of one embodiment of the invention while in a silk screening position. A silk screening device 200 is shown along with its constituent parts, including: a frame 205, rails 210, rail guards 215, first set of columns 220 for supporting silk screen squeegee parts, first cross bar 225, silk screen squeegee holder 230, platen 235 for supporting articles to be silk screened, second set of columns 240 for supporting quartz flash unit 250, second cross bar 245, and quartz flash unit guard 255. While the silk screening device 200 is in the position illustrated in FIG. 2, the quartz flash unit 250 is moved away from the platen 235, such that the silk screen squeegee holder 230 may pass unobstructed over the platen 235.

Figure 3:
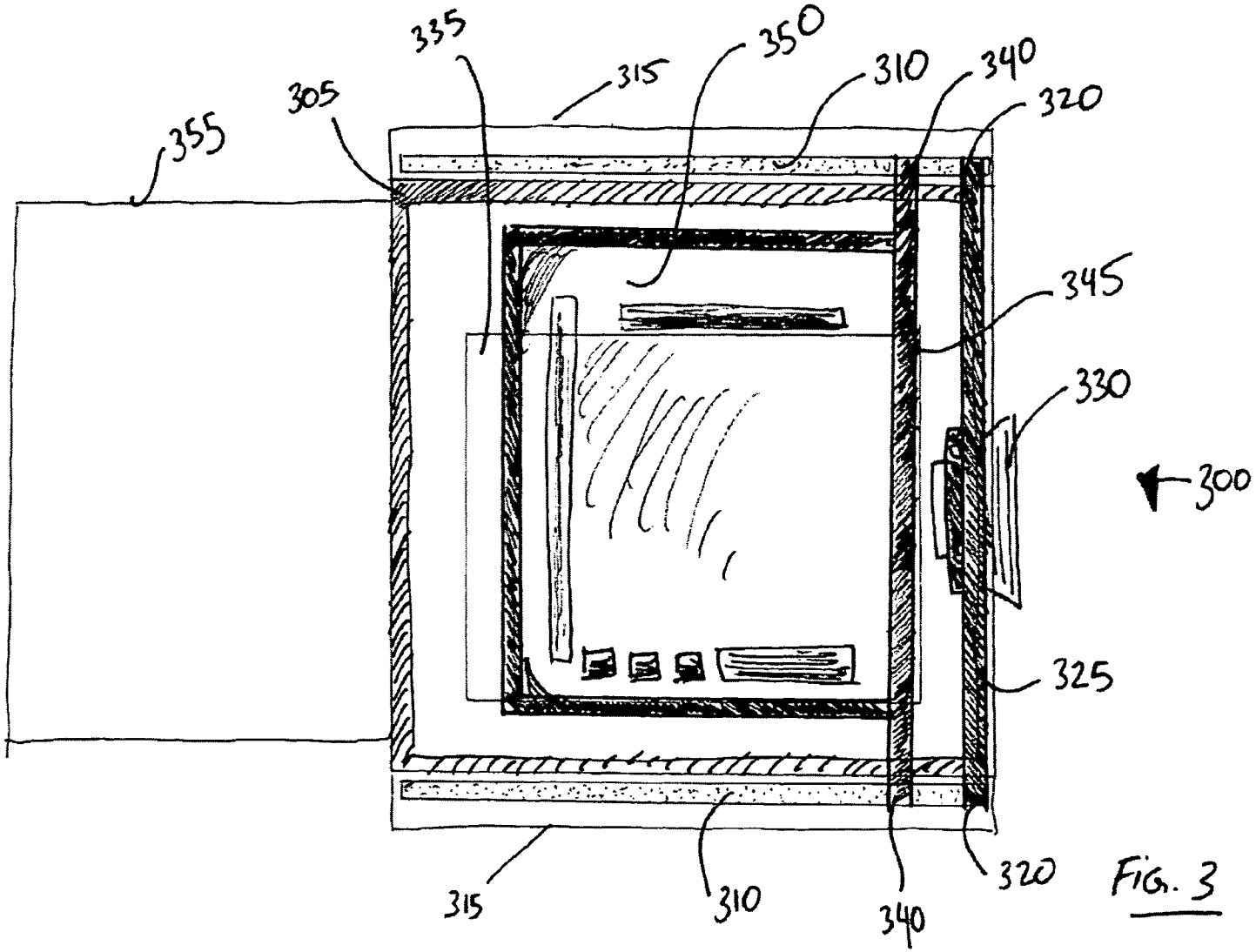
FIG. 3 is an illustration from a top view of one embodiment of the invention while in a quartz flash position.

FIG. 3 is an illustration from a top view of one embodiment of the invention while in a quartz flash position. A silk screening device 300 is shown along with its constituent parts, including: a frame 305, rails 310, rail guards 315, first set of columns 320 for supporting silk screen squeegee parts, first cross bar 325, silk screen squeegee holder 330, platen 335 for supporting articles to be silk screened, second set of columns 340 for supporting quartz flash unit 350, second cross bar 345, and quartz flash unit guard 355. While the silk screening device 300 is in the position illustrated in FIG. 3, silk screen squeegee holder 330 is moved away from the platen 335, such that the quartz flash unit 350 may pass unobstructed over the platen 335 and irradiate the article.

Figure 4A:
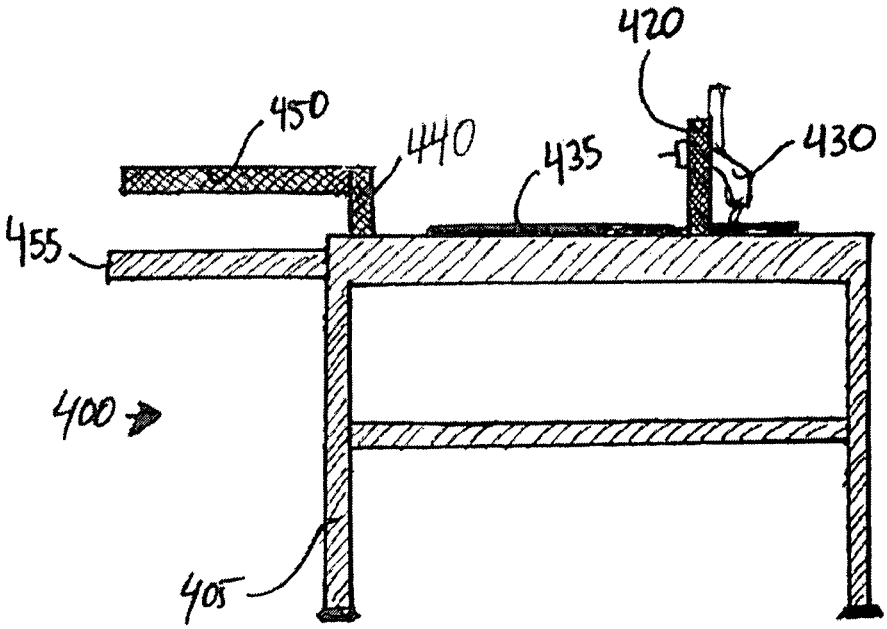
FIG. 4A is an illustration from a side view of one embodiment of the invention while in a silk screening position.

FIG. 4A is an illustration from a side view of one embodiment of the invention while in a silk screening position. A silk screening device 400 is shown along with its constituent parts, including: frame 405, first set of columns 420, silk screen squeegee holder 430, platen 435, second set of columns 440, quartz flash unit 450, and quartz flash unit guard 455. Note that while in this position, the quartz flash unit 450 is moved away from the platen 435, such that the device may be used for silk screening operations.

Figure 4B:
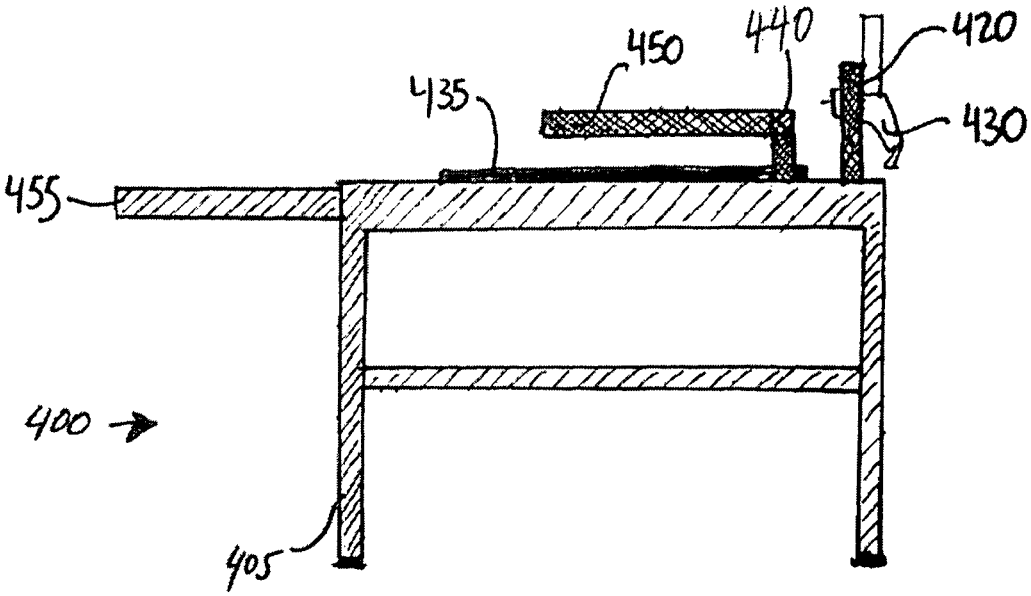
FIG. 4B is an illustration from a side view of one embodiment of the invention while in a quartz flash position.

FIG. 4B is an illustration from a side view of one embodiment of the invention while in a quartz flash position. A silk screening device 400 is shown along with its constituent parts, including: frame 405, first set of columns 420, silk screen squeegee holder 430, platen 435, second set of columns 440, quartz flash unit 450, and quartz flash unit guard 455. Note that while in this position, the silk screen squeegee holder 430 is moved away from the platen 435, such that the device may be used for quartz flash operations by bringing the quartz flash unit 450 over the platen 435.

Figure 5A:
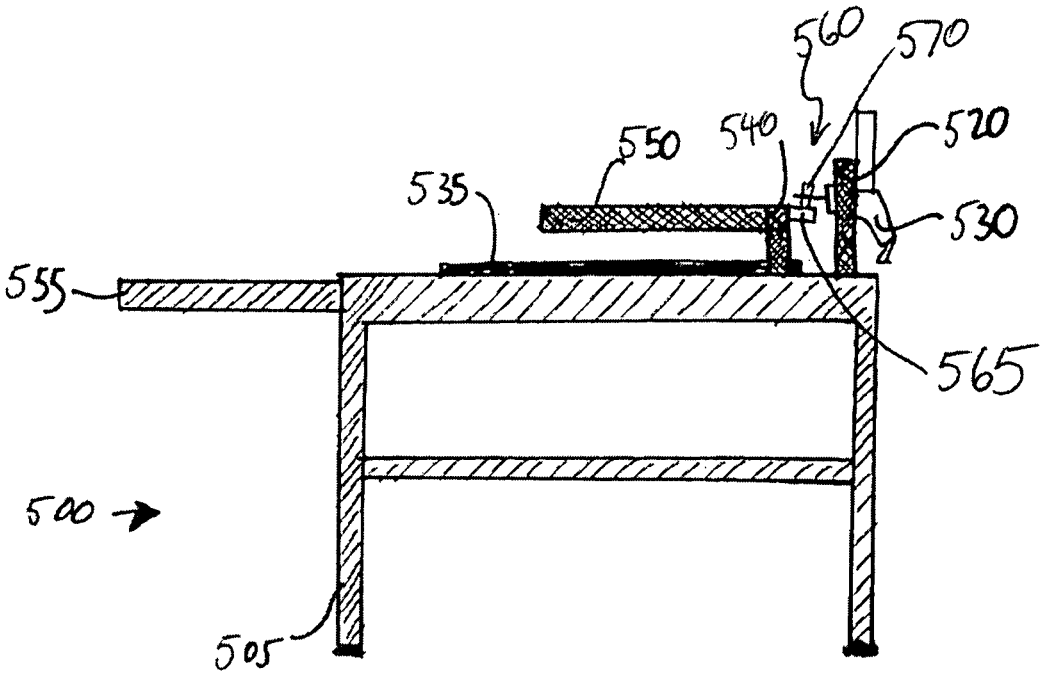
FIG. 5A is an illustration from a side view of one embodiment of the invention while in a first coupled position.

FIG. 5A is an illustration from a side view of one embodiment of the invention while in a first coupled position. A silk screening device 500 is shown along with its constituent parts, including: frame 505, first set of columns 520, silk screen squeegee holder 530, platen 535, second set of columns 540, quartz flash unit 550, quartz flash unit guard 555, and coupling interface 560. While in this position, the silk screen squeegee holder 530 is adjacent the quartz flash unit 550, such that the silk screen squeegee holder 530 is coupled to the quartz flash unit 550 via the coupling interface 560. When coupled to each other, the silk screen squeegee holder 530 can be used to move the quartz flash unit 550 over the platen 535, in a position for quartz flash operations, as illustrated. Furthermore, the silk screen squeegee holder 530 then can be decoupled from the quartz flash unit 550 and moved out of the way, such that quartz flash operations can be carried out unobstructed. The coupling interface 560, as illustrated, includes a bar 565 extending from the front of the quartz flash unit 550, having set screws 570 attachable to the silk screen squeegee holder 530. However, the coupling interface 560 can be configured using alternate interfaces, including mechanical, electronic, magnetic, pneumatic, and/or hydraulic linkages, or other couplings.

Figure 5B:
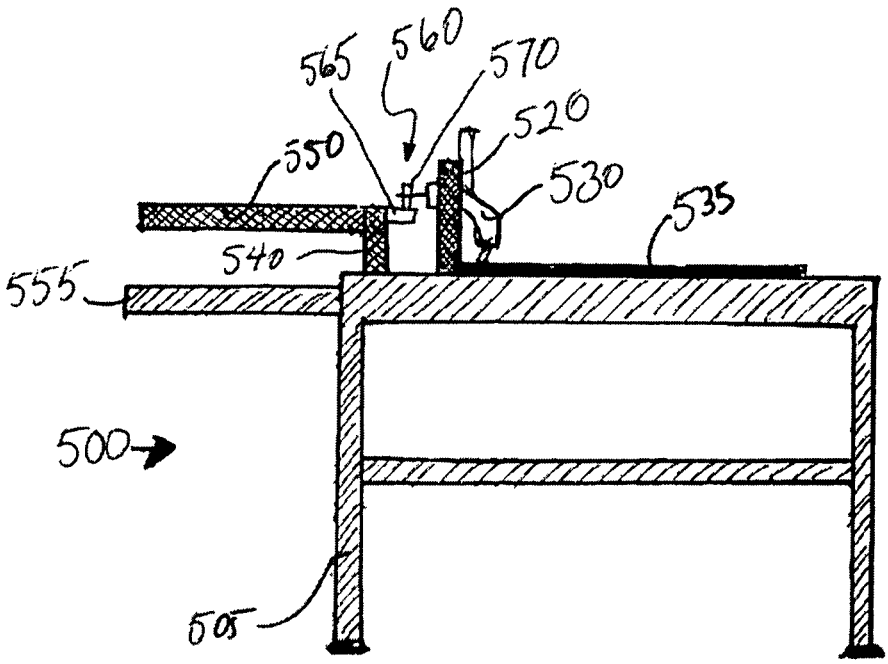
FIG. 5B is an illustration from a side view of one embodiment of the invention while in a second coupled position.

FIG. 5B is an illustration of the embodiment of FIG. 5A while in a second coupled position. A silk screening device 500 is shown along with its constituent parts, including: frame 505, first set of columns 520, silk screen squeegee holder 530, platen 535, second set of columns 540, quartz flash unit 550, quartz flash unit guard 555, and coupling interface 560. While in this position, the silk screen squeegee holder 530 is adjacent the quartz flash unit 550, such that the silk screen squeegee holder 530 is coupled to the quartz flash unit 550 via coupling interface 560. When coupled to each other, the silk screen squeegee holder 530 can be used to move the quartz flash unit 550 away from the platen 535, such that silk screening operations can be carried out unobstructed after the silk screen squeegee holder 530 is decoupled from the quartz flash unit 550.

Figure 6:
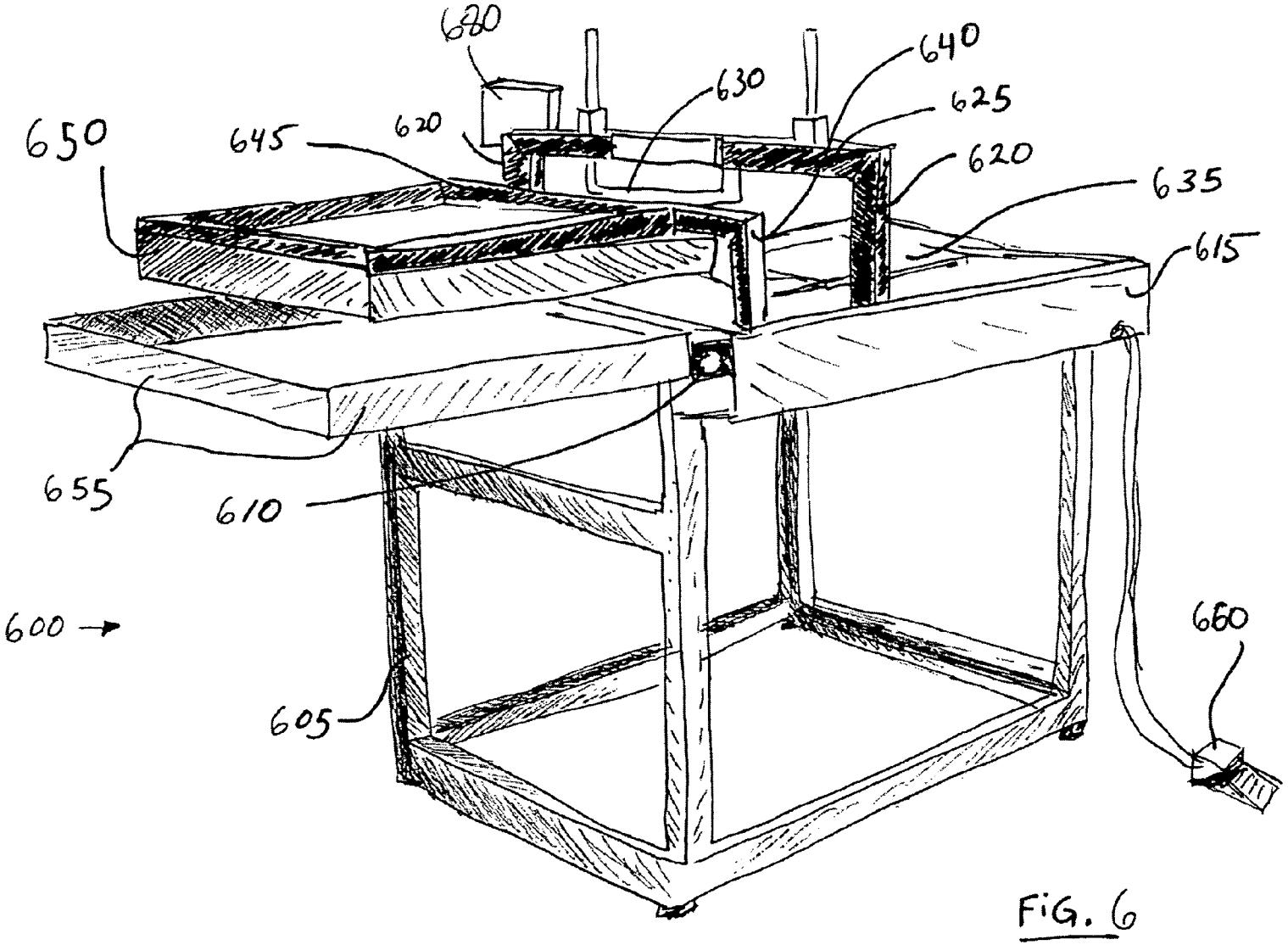
FIG. 6 is an illustration in perspective view of one embodiment of the invention while in a silk screening position, including a timer.

FIG. 6 is an illustration in perspective view of one embodiment of the invention while in a time-synchronized silk screening position. A silk screening device 600 is shown along with its constituent parts, including: a frame 605, rails 610, rail guard 615, first set of columns 620 for supporting silk screen squeegee parts, first cross bar 625, silk screen squeegee holder 630, platen 635 for supporting articles to be silk screened, second set of columns 640 for supporting quartz flash unit 650, second cross bar 645, quartz flash unit guard 655, and foot switch 660. Also, timer 680 is shown, which may be used to synchronize and coordinate the quartz flash and silk screen operations. Utilizing timer 680 enables the system to operate with added consistency and time savings.

What is claimed is:

1. A silk screening device, comprising: a frame, said frame being configured to mount components of said silk screen apparatus, wherein said components include: a platen mounted to said frame, said platen being configured to removably mount an article for silk screening and irradiating operations, a frame holder, said frame holder being configured to removably attach silk screening frames to said frame, a silk screen squeegee mount, said silk screen squeegee mount being slidably attached to said frame such that said silk screen squeegee mount may pass over said platen for silk screening articles on said platen, and a quartz flash unit, said quartz flash unit being slidably attached to said frame such that said quartz flash unit may be placed over said platen for irradiating articles on said silk screening device, a coupling interface disposed between the silk screen squeegee mount and the quartz flash unit, said coupling interface is configured to selectively couple the silk screen squeegee mount to the quartz flash unit such that the silk screen squeegee mount and the quartz flash unit slidably move together.

2. A silk screening device according to claim 1, wherein said quartz flash unit features tungsten filament lamps for irradiating said article.

3. A silk screening device according to claim 1, wherein said quartz flash unit features a foot switch for activating said quartz flash unit.

4. A silk screening device according to claim 1, further comprising a timer configured to coordinate and synchronize the silk screening and irradiating of articles for consistency and time savings.

5. A silk screening device, comprising:

a frame having outside edges, said frame being configured to mount components of said silk screen apparatus, a platen mounted to said frame, said platen being configured to removably mount an article for silk screening and irradiating operations, a frame holder, said frame holder being configured to removably attach silk screening frames to said frame, a set of rails, said set of rails mounted to said frame and located adjacent to two opposite outside edges of said frame, said set of rails being configured to slidably mount a first set of columns and a second set of columns, said first set of columns being mounted to said set of rails such that bases of said first set of columns are slidably attached to said set of rails and crowns of said first set of columns attach to a first cross bar, said first cross bar being generally horizontal and extending horizontally between said first set of columns, said first cross bar attaching a silk screen squeegee mount, said silk screen squeegee mount being slidably attached to said first cross bar such that said silk screen squeegee mount may pass over said platen for silk screening articles on said platen, said second set of columns being mounted to said set of rails such that bases of said columns are slidably attached to said set of rails and crowns of said second columns attach to a second cross bar, said second cross bar being generally horizontal and extending horizontally between said second set of columns, said second cross bar attaching a quartz flash unit, said quartz flash unit being attached to said second cross bar such that said quartz flash unit may be placed over said platen for irradiating said articles and moved from said platen to allow silk screening operations.

6. A silk screening device according to claim 5, wherein said quartz flash unit features tungsten filament lamps for irradiating said article.

7. A silk screening device according to claim 5, wherein said quartz flash unit features a foot switch for activating said quartz flash unit.

8. A silk screening device according to claim 5, wherein said frame holder includes a pin registration system for alignment of silk screening frames.

9. A silk screening device according to claim 5, further comprising a coupling interface between the silk screen squeegee mount and the quartz flash unit, configured to selectively couple the silk screen squeegee mount to the quartz flash unit such that the silk screen squeegee mount and the quartz flash unit slidably move together.

10. A silk screening device according to claim 5, further comprising a timer configured to coordinate and synchronize the silk screening and irradiating of articles for consistency and time savings.

11. A silk screening device according to claim 5, wherein said first set of columns are telescoping such that the distance between the silk screen squeegee mount and the platen is adjustable.

12. A silk screening device according to claim 5, wherein said second set of columns are telescoping such that the distance between the quarts flash unit and the platen is adjustable.

* * * * *